United States Patent [19]

Smith, Jr.

[11] Patent Number: 4,715,445

[45] Date of Patent: Dec. 29, 1987

[54] LATCH AND RETRIEVING ASSEMBLY

[75] Inventor: Sidney K. Smith, Jr., Huntsville, Tex.

[73] Assignee: Hughes Tool Company, Houston, Tex.

[21] Appl. No.: 939,652

[22] Filed: Dec. 9, 1986

[51] Int. Cl.[4] ..... E21B 23/00; E21B 31/20

[52] U.S. Cl. ..... 166/377; 166/98; 166/217; 166/237; 294/86.17; 294/86.25

[58] Field of Search ..... 166/98, 301, 377, 382, 166/381, 217, 206, 237, 115, 123, 125; 294/86.24, 86.25, 86.18, 86.17, 86.16; 285/3, 39, 141

[56] References Cited

U.S. PATENT DOCUMENTS

| | | | |
|---|---|---|---|
| 3,150,718 | 9/1964 | Crowe | 294/86.25 |
| 3,789,925 | 2/1974 | Brown | 166/125 |
| 3,888,306 | 6/1975 | Wetzel | 166/237 X |
| 4,368,911 | 1/1983 | Pringle | 166/98 X |
| 4,616,721 | 10/1986 | Furse | 294/86.18 |

FOREIGN PATENT DOCUMENTS

| | | | |
|---|---|---|---|
| 638707 | 12/1978 | U.S.S.R. | 294/86.25 |

*Primary Examiner*—James A. Leppink
*Assistant Examiner*—Hoang C. Dang
*Attorney, Agent, or Firm*—Charles D. Gunter, Jr.

[57] ABSTRACT

A latch and retrieving assembly is shown for use with a well tool having an axial bore which includes an external landing shoulder and an annular latch recess which is spaced below the landing shoulder. The assembly includes a mandrel which is inserted in to the bore of the well tool. The mandrel has a lower abutment and a collet member carried about the mandrel above the abutment. The collet member includes a carrier ring which is seatable on the shoulder and a plurality of fingers which depend from the carrier ring and which terminate in radially enlarged tips which are disposed in registration with the recess when the carrier ring is seated on the landing shoulder. The tips cooperate with the lower abutment to latch into and to be released from the recess respectively in response to downward movement of the mandrel. A special profile formed on the mandrel lower abutment provides latching engagement and subsequent release of the assembly upon downward movement of the mandrel relative to the collet.

7 Claims, 6 Drawing Figures

LATCH AND RETRIEVING ASSEMBLY

BACKGROUND OF THE INVENTION

1. Field of the Invention

This invention relates to a latch assembly of the type used for releasably securing one well tool to another and for retrieving a well tool from a well bore.

2. Description of the Prior Art

In the operation of oil and gas wells, it is necessary to equip the wells with various types of tools used in completion, treating and producing operations. These tools may be intended to be used temporarily and then be retrieved, while other tools are designed to be left for long periods of time but to be removed when required in the course of operation of the well. Tools of the above type include various types of packers, anchors, testing tools, and others well known in the oil and gas industry. On occasion, two or more different tools are run together and set or operated sequentially or one tool is run following another already in place in the well and secured thereto. It is sometimes desirable that several tools be separately retrieved. In the past, such operations have involved the use of running and retrieving tools which were relatively complex in design, difficult to operate, and subject to breakage.

It is the object of the present invention to provide an improved latch assembly which overcomes the disadvantages of the prior art tools, and which is adapted to be used for releasably securing one tool to another, for retrieving tools in place in a well, and for use in conducting other tool-running and retrieving operations in a well.

The tool in accordance with this invention is designed for use with other tools which are initially equipped with a tubular support structure, which can function as a landing unit or nipple and which is provided with an internal landing shoulder and an annular latch recess spaced below the landing shoulder. Such shoulder and recess can be provided in a landing unit or sub which forms a part of a well tool, or may be provided in the bore wall of the central body or mandrel of a packer, well anchor or any other well tool which is supported on a tubular body.

SUMMARY OF THE INVENTION

The foregoing objects are accomplished by the latch and retrieving assembly of the invention which is designed for use with a well tool having an axial bore, the wall of the bore having an internal landing shoulder and an annular latch recess or groove spaced below the landing shoulder. The assembly includes a mandrel which is insertable in the bore of the well tool, the mandrel having upper connecting means for connection in a well pipe string extending to the well surface. The mandrel has a lower abutment and a collect member slidably mounted about the mandrel. The collect member includes a carrier ring which is seatable on the shoulder and has a plurality of elongate, resilient fingers depending from the carrier ring and terminating in radially enlarged tips which are disposed in registration with the recess when the carrier ring is seated on the landing shoulder. The tips cooperate with the lower abutment to latch into and to be released from the recess respectively in response to downward movement of the mandrel.

Preferably, the lower abutment includes a carrying groove adjacent a lowermost extent of the mandrel which is joined by an upwardly slanting wall region to a plateau region. A downwardly slanting wall region joins the plateau region to a releasing groove. The plateau region has a retaining shoulder for engaging the collect tips which allows downward relative movement of the mandrel but thereafter restricts upward relative movement.

A torque sleeve is carried about the mandrel above the collect carrier ring which is engaged with the carrier ring for transmitting torque from the well pipe string to the collect carrier ring. The carrier ring has a plurality of radially extending torque lugs which are received within mating slots in the bore of the well tool for transmitting torque, in turn, to the well tool. The collect carrier ring and the torque sleeve are joined by torque override means operable to permit downward movement of the torque sleeve and the mandrel relative to the collect carrier ring upon the application of a predetermined torque load to the well pipe string for emergency rotational release of the assembly from the well tool.

Additional objects, features and advantages will be apparent in the written description which follows.

DETAILED DESCRIPTION OF THE INVENTION

Figure 1A:
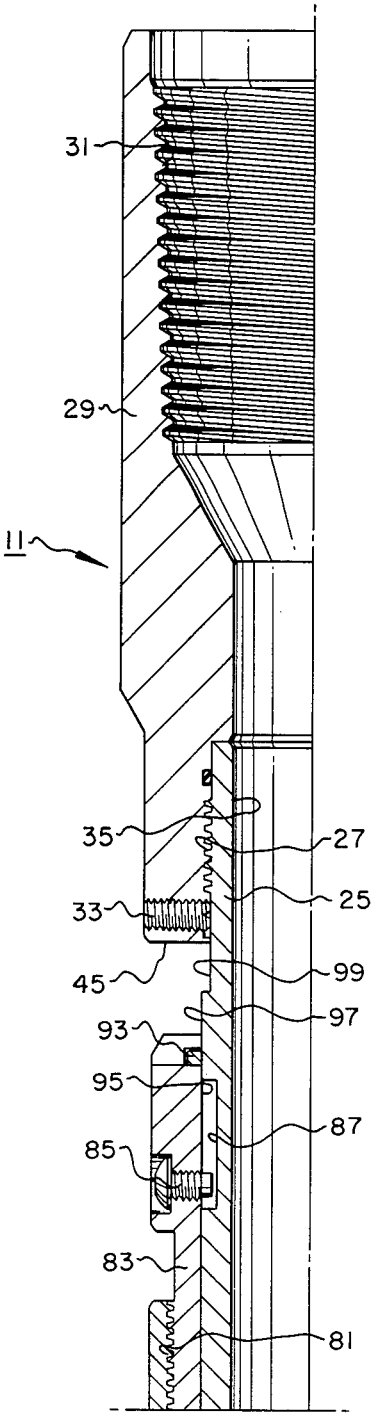
FIG. 1A is a partial side, cross-sectional view of the latching and retrieving assembly of the invention.
Figure 1B:
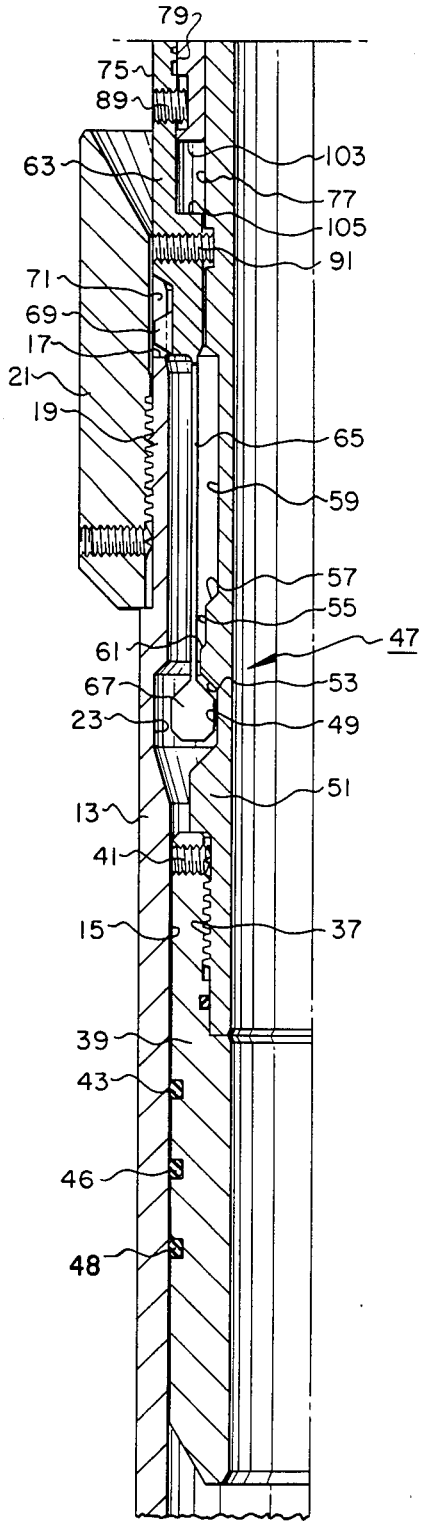
FIG. 1B is a downward continuation of the assembly of FIG. 1 showing the running-in position within the bore of a surrounding well tool.

FIGS. 1A and 1B show a latch and retrieving assembly designated generally as 11. The latch and retrieving assembly 11 is intended for use with a well tool 13 having an axial bore 15. The wall of the bore 15 has an internal landing shoulder 17 which is formed by the junction of the externally threaded tubular member 19 with the internally threaded box number 21. The bore 15 is also provided with a latch recess 23, preferably an annular groove, which is spaced below the landing shoulder 17. The well tool 13 can be, for instance, a retrievable landing unit previously set by a running tool and left in the well bore.

The assembly 11 of the invention includes a tubular mandrel 25 having an externally threaded surface 27 which matingly engages the internally threaded surface of a box member 29. The box member 29 has an internally threaded surface 31 for connection in a well pipe string extending to the well surface. One or more set screws 33 can be provided for afixing the box member 29 to the mandrel 25. The mandrel 25 has an internal bore 35 which communicates with the bore of the pipe string (not shown) leading to the well surface. The mandrel 25 also has an externally threaded surface 37 at the lower extent thereof which is engaged by a lower sub 39 which is fixed in position by one or more set screws 41. The lower sub 39 has one or more circumferential O-rings 43, 46, 48 carried in O-ring grooves for forming a sliding seal with the axial bore 15 of the well tool 13.

The junction of the box member 29 with the tubular mandrel 25 forms an upper abutment 45. The mandrel also has a lower abutment indicated generally as the region 47 in FIG. 1B. The lower abutment 47 includes a carrying groove 49 of lesser relative external diameter adjacent a lower-most extent 51 of the mandrel which is joined by an upwardly slanting wall region 53 to a plateau region 55. The plateau region is of greater external diameter than the carrying groove 49 and is joined by a downwardly slanting wall region 57 to a releasing groove 59. The plateau region 55 includes a retaining shoulder 61. As seen in FIG. 1B, the plateau region 55 is thus itself a split level surface formed by a region of greater relative mandrel diameter joined by a downwardly slanting wall region to a region of lesser relative mandrel diameter. In the specification, "up" will be in the direction of the box member 29 and "down" will be in the direction of the sub 39.

The assembly 11 also includes a collet member slidably mounted about the mandrel 25. The collet member includes a carrier ring 63 which is seatable on the shoulder 17 and which has a plurality of elongate, resilient fingers 65 which terminate in radially enlarged tips 67 which are disposed in registration with the recess 23 when the carrier ring 63 is seated on the landing shoulder 17. As will be explained, the tips 67 cooperate with the lower abutment 47 to latch into and to be released from the recess 23 respectively in response to downward movement of the mandrel 25.

The collet carrier ring 63 includes a plurality of radially extending torque lugs 69 which are received within mating axially extending slots 71 in the bore of the well tool adjacent the shoulder 17 whereby torque transmitted from the well surface through the pipe string can be transmitted from the collet to the well tool.

Figure 2A:
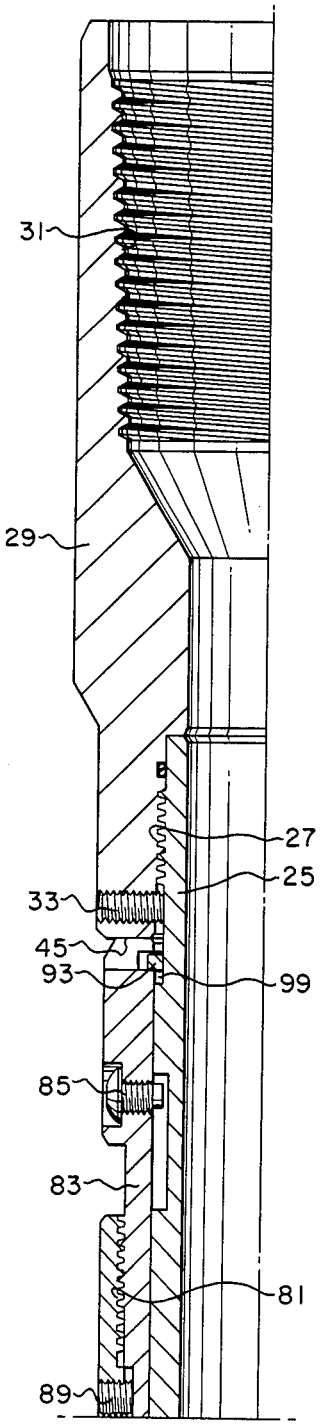
FIG. 2A is a view similar to FIG. 1A with weight having been set down from the surface.
Figure 2B:
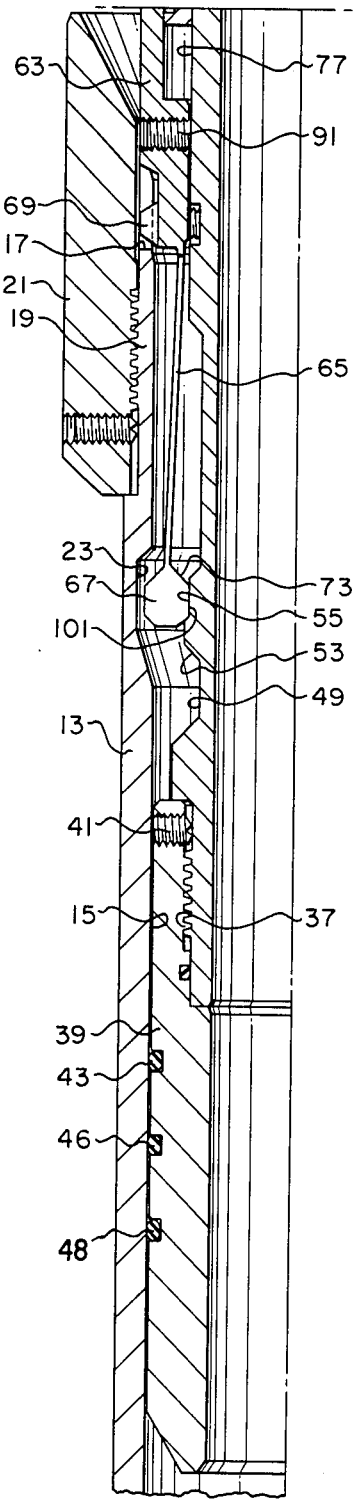
FIG. 2B is a downward continuation of the assembly of FIG. 2A showing the collect tips supported on the plateau region of the lower abutment of the assembly.

As shown in FIG. 2B, the collet tips are provided with a lower slanting surface 73 which is complementary to the upwardly slanting wall region 53 of the mandrel for movement between a running-in position shown in FIG. 1B and a latch position shown in FIG. 2B. In the latch position of FIG. 2B, the retaining shoulder 61 of the mandrel plateau region prevents upward movement of the tubular mandrel 25 past the collet tips 67.

As shown in FIG. 1B, the collet carrier ring 63 has an upper extent 75 which is spaced apart from the mandrel external region 77 and has an internally threaded surface 79 which engages an externally threaded surface 81 of a torque sleeve 83 carried about the mandrel exterior above the carrier ring 63. The torque sleeve 83 has at least one radially extending torque pin 85 which is received within a longitudinal slot 87 on the mandrel exterior, whereby torque applied to the mandrel 25 is transmitted through the torque pin 85 to the torque sleeve 83 and through the torque sleeve 83 to the collet carrier ring 63. The position of the torque sleeve 83 is initially fixed relative to the carrier ring 63 due to the presence of one or more shear screws 89 which pass between the torque sleeve 83 and the carrier ring 63. The shear screws 89 have a predetermined shear resistance to allow movement of the threaded surface 81 down the internally threaded surface 79 upon the application of a predetermined rotational torque from the well surface. The position of the mandrel 25 with respect to the collet carrier ring 63 is also initially fixed due to the presence of one or more shear screws 91 which pass between the mandrel 25 and the carrier ring 63. The shear screws 91 have a predetermined shear resistance which is overcome by setting down weight on the mandrel 25 from the well surface, as will be explained.

A snap ring 93 is carried by the torque sleeve 83 in a groove provided on the internal surface 95 thereof. The snap ring 93 is of square cross-sectional dimension and is split at one point (not shown) in the circumference to allow the ring to be forcibly expanded to the position shown in FIG. 1A. The snap ring 93 slidably engages the mandrel external region 97 and is adapted to be received within a locking groove 99 on the mandrel adjacent the upper abutment 45. The locking groove 99 is located a predetermined distance above the snap ring 93 in the running-in position shown in FIGS. 1A and 1B. As the mandrel is moved downward relative to the torque sleeve 83, the snap ring contracts to a relaxed position and is received within the locking groove 99, as shown in FIG. 2A to prevent upward relative movement of the mandrel. The distance between the snap ring 93 and the locking groove 99 corresponds to the downward travel of the mandrel in moving the plateau region 55 of the mandrel beneath the collet tips 67 to latch the collet tips 67 within the tool recess 23.

The operation of the latch and retrieving assembly of the invenion will now be described. The assembly is made up in a well pipe string by means of the internally threaded box 29 and is run into the axial bore 15 of the well tool 13 as shown in FIGS. 1A and 1B. The assembly is located within the well tool 13 by contact between the carrier ring 63 and the landing shoulder 17. The torque lugs 69 of the carrier ring are also received within the longitudinal slots 71 provided in the axial bore of the well tool. When the carrier ring contacts the landing shoulder 17, the carrier ring 63 is initially pinned to the mandrel by shear screws 91. The length of the collet fingers 65 is selected whereby the collet tips 67 are in approximate registry with the well tool recess 23, as shown in FIG. 1B.

In order to latch the assembly within the recess 23, weight is now set down upon the pipe string from the well surface, thereby shearing the screws 91, as shown in FIGS. 2A and 2B. Downward movement of the mandrel relative to the carrier ring 63 continues until the upper abutment 45 of the box member 29 contacts the upper surface of the torque sleeve 83. As the mandrel moves downwardly with respect to the carrier ring 63, the collet slanting surface 73 moves up the upwardly slanting wall region 53 of the mandrel, thereby allowing the plateau region 55 to underlie the collet inner surface 101 (FIG. 2B). This action causes the collet fingers 65 to flex outwardly, thereby latching the collet tips 67 within the surrounding recess 23. The retaining shoulder 61 of the plateau region 55 prevents upward movement of the mandrel past the collet tip 67. Also, the snap ring 93 has now moved radially inward within the locking groove 99 of the mandrel 25. As a result, the well tool 13 can now be removed from the well bore by picking up on the well string extending to the well surface. If radial torque is needed to release the well tool, this can be accomplished by rotating the well string from the well surface. Torque is applied through the torque pins 85 to the torque sleeve 83 and through the torque sleeve threaded connection to the carrier ring 63. Torque is then transmitted from the carrier ring torque lugs 69 to the well tool.

Figure 3A:
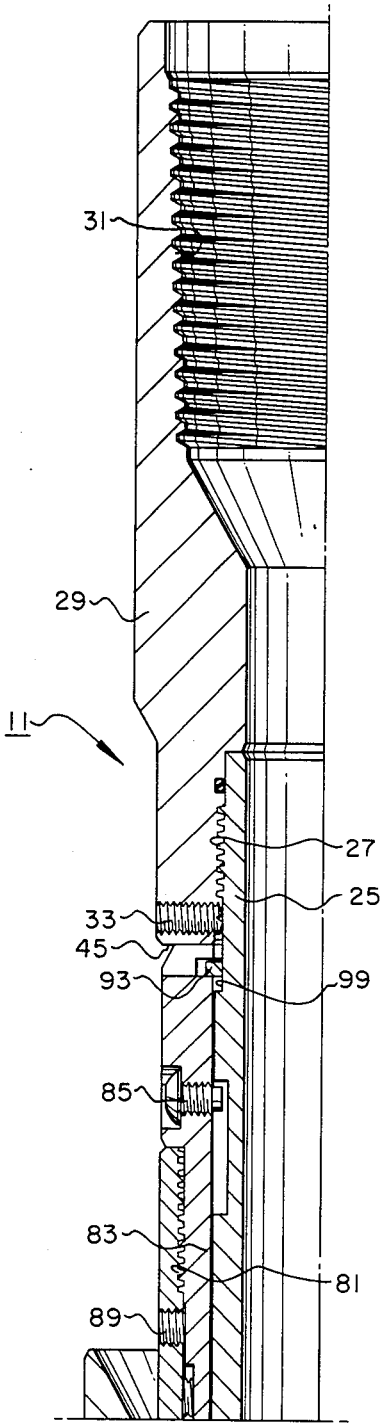
FIG. 3A is a view similar to FIG. 2A of the assembly of the invention showing the rotational release position.
Figure 3B:
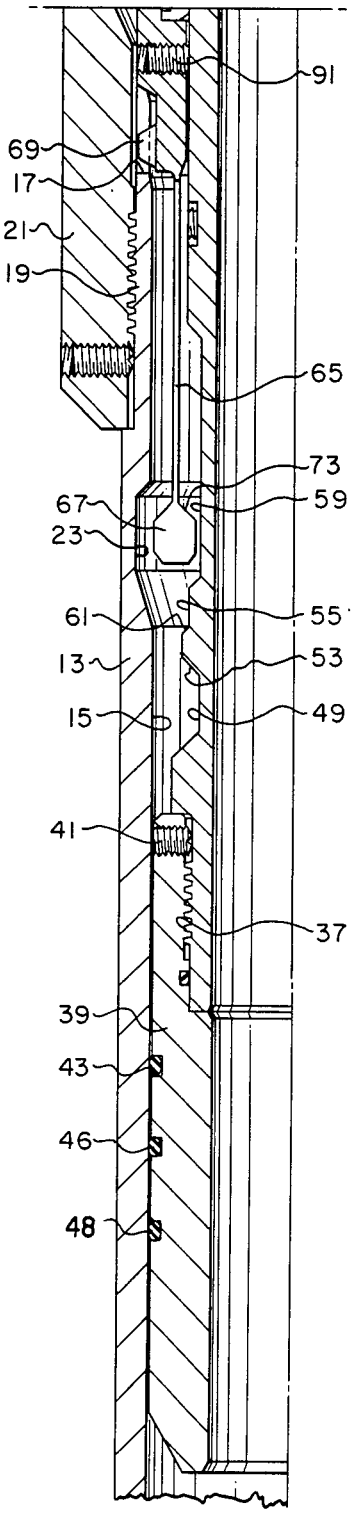
FIG. 3B is a downward continuation of the assembly of FIG. 3A showing the collect tips in the release groove.

If, for some reason, the well tool 13 cannot be retrieved by axial movement or rotational torque, an emergency release is provided for releasing the retrieving assembly. The shear screws 89 in the carrier ring 63 comprise torque override means operable to permit downward movement of the torque sleeve 83 and mandrel relative to the collet carrier ring 63 upon the application of a predetermined torque load to the well pipe string. That is, sufficient rotational torque from the well surface shears the screws 89 allowing the torque sleeve 83 to travel down the threaded surface 79 of the carrier ring until the torque sleeve lower lip 103 contacts the internal shoulder 105 of the carrier ring. This longitudinal travel allows the releasing groove 59 to move beneath the collet tip 67, thereby releasing the collet tips from latching engagement with the well tool recess 23 (FIG. 3B). The assembly 11 can then be retrieved to the well surface leaving the well tool within the well bore.

An invention has been provided with several advantages. The latch and retrieving assembly of the invention can be used with a variety of well tools which incorporate a landing shoulder and internal recess. The assembly is simple in design and latches into engagement with the well tool by simply setting weight down on the well string from the surface. The assembly can then be used to supply either rotational torque or upward pull to the well tool for retrieval to the well surface. In the event that the well tool cannot be released from engagement with the well bore, the assembly of the invention is provided with an emergency release feature which allows the assembly to be safely retrieved to the well surface.

While the invention has been shown in only one of its forms, it is not thus limited but it susceptible to various changes and modifications without departing from the spirit thereof.

I claim:

1. A latch and retrieving assembly for use with a well tool having an axial bore, the wall of the bore having an internal landing shoulder and an annular latch recess spaced below the landing shoulder, the assembly comprising:

a mandrel insertable in the bore of the well tool, the mandrel having upper connecting means for connection in a well pipe string extending to the well surface;

a lower abutment on the mandrel;

a collet member slidably mounted about the mandrel, the collet member including a carrier ring seatable on the shoulder and a plurality of elongate, resilient fingers depending from the carrier ring and terminating in radially enlarged tips disposed in registration with the recess when the carrier ring is seated on the landing shoulder, the tips cooperating with the lower abutment to latch into and to be released from the recess respectively in response to downward movement of the mandrel;

the lower abutment including a carrying groove adjacent a lowermost extent of the mandrel, an upwardly slanting wall region which joins the carrying groove to a plateau region, and a downwardly slanting wall region which joins the plateau region to a releasing groove, whereby downward movement of the mandrel moves the collet tips onto the plateau region and radially outward into latching engagement with the recess and whereby continued downward movement of the mandrel moves the releasing groove beneath the collet tips to allow inward radial movement of the collet tips for disengagement with the recess, the plateau region having a retaining shoulder for engaging the collet tips which allows downward relative movement of the mandrel but thereafter restricts upward relative movement; and wherein the collet carrier ring includes a plurality of radially extending torque lugs which are received within mating slots in the bore of the well tool whereby torque transmitted from the well surface through the pipe string is transmitted from the collet to the well tool.

2. A latch and retrieving assembly for use with a well tool having an axial bore, the wall of the bore having an internal landing shoulder and an annular latch recess spaced below the landing shoulder, the assembly comprising:

a mandrel insertable in the bore of the well tool, the mandrel having upper connecting means for connection in a well pipe string extending to the well surface;

a lower abutment on the mandrel;

a collet member slidably mounted about the mandrel, the collet member including a carrier ring seatable on the shoulder and a plurality of elongate, resilient fingers depending from the carrier ring and terminating in radially enlarged tips disposed in registration with the recess when the carrier ring is seated on the landing shoulder, the tips cooperating with the lower abutment to latch into and to be released from the recess respectively in response to downward movement of the mandrel; and a torque sleeve carried about the mandrel above the collet carrier ring and engaged with the carrier ring for transmitting torque from the well pipe string to the collet carrier ring, the carrier ring having a plurality of radially extending torque lugs which are received within mating slots in the bore of the well tool for transmitting torque, in turn, to the well tool.

3. The latch and retrieving assembly of claim 2 wherein the collet carrier ring and the torque sleeve are joined by torque override means operable to permit downward movement of the torque sleeve and the mandrel relative to the collet carrier ring upon the application of a predetermined torque load to the well pipe string for emergency rotational release of the assembly from the well tool.

4. The latch and retrieving assembly of claim 3, wherein the lower abutment includes a carrying groove adjacent a lowermost extent of the mandrel, an upwardly slanting wall region which joins the carrying groove to a plateau region, and a downwardly slanting wall region which joins the plateau region to a releasing groove, whereby downward movement of the mandrel moves the collet tips onto the plateau region and radially outward into latching engagement with the recess and whereby continued downward movement of the mandrel moves the releasing groove beneath the collet tips to allow inward radial movement of the collet tips for disengagement with the recess, the plateau region having a retaining shoulder for engaging the collet tips which allows downward relative movement of the mandrel but thereafter restricts upward relative movement, and wherein the torque override means includes an internally threaded surface of the collet carrier ring which matingly engages an exterior surface of the torque ring.

5. The latch and retrieving assembly of claim 4, wherein the torque override means further includes shear means connecting the carrier ring and torque sleeve for initially preventing movement of the carrier ring threaded surface over the threaded surface of the torque ring.

6. The latch and retrieving assembly of claim 5, further comprising:

a snap ring carried by the torque sleeve in sliding engagement with the mandrel exterior, the mandrel exterior having a locking groove located a predetermined distance above the snap ring for receiving the snap ring as the mandrel is moved downward relative to the torque ring, the distance between the snap ring and locking groove corresponding to the downward travel of the mandrel in moving the plateau region beneath the collet tips.

7. A method of latching a retrieving assembly to a well tool having an axial bore, the wall of the bore having an internal landing shoulder and an annular latch recess spaced below the landing shoulder, the method comprising the steps of:

inserting a mandrel within the bore of the well tool, the mandrel being connected in a well pipe string extending to the well surface;

providing a lower abutment on the mandrel and a collet member slidably mounted about the mandrel, the collet member including a carrier ring seatable on the shoulder and a plurality of elongate, resilient fingers depending from the carrier ring and terminating in radially enlarged tips disposed in registration with the recess when the carrier ring is seated on the landing shoulder, the tips cooperating with the lower abutment to latch into and to be released from the recess respectively in response to downward movement of the mandrel;

running the mandrel into the bore of the tool until the carrier ring seats on the shoulder;

setting down weight on the pipe string from the well surface to move the mandrel a selected downward distance to latch the collet tips within the recess of the well tool; and rotating the pipe string from the well surface to move the mandrel an additional downward distance to release the collet tips from latching engagement with the recess.

* * * * *